US005806768A

United States Patent [19]

Engel

[11] Patent Number: 5,806,768

[45] Date of Patent: Sep. 15, 1998

[54] INFLATABLE WATER TOY

[76] Inventor: Robert W. Engel, 548 N. Hollyburne La., Thousand Oaks, Calif. 91360

[21] Appl. No.: 721,438

[22] Filed: Sep. 27, 1996

[51] Int. Cl.[6] ..... A63H 3/06; A63H 15/06; B05B 15/06

[52] U.S. Cl. ..... 239/289; 239/548; 446/226; 446/325

[58] Field of Search ..... 239/211, 289, 239/548, 556, 562; 446/156, 220, 226, 325, 396

[56] References Cited

U.S. PATENT DOCUMENTS

| | | | |
|---|---|---|---|
| 4,235,378 | 11/1980 | Melin et al. | 239/229 |
| 4,655,722 | 4/1987 | Baron et al. | 446/226 |
| 4,770,412 | 9/1988 | Wolfe | 272/77 |
| 4,787,875 | 11/1988 | Baron et al. | 446/226 |

FOREIGN PATENT DOCUMENTS

| | | | |
|---|---|---|---|
| 1553161 | 3/1990 | U.S.S.R. | 446/325 |

*Primary Examiner*—Lesley D. Morris
*Attorney, Agent, or Firm*—Charles B. Katz

[57] ABSTRACT

A self-righting inflatable toy coupleable to a source of pressurized water for producing water sprays emanating from the toy's top and sides. The toy comprises a ballasted inflatable housing including a rounded base portion and an elongated shaft portion. An upper spray producing mechanism disposed in the distal end of the shaft is provided for selectively creating a water spray directed vertically upward from the shaft. Dual-channelled tubing mechanism carried on the outer surface of the housing connect the upper spray producing mechanism to the water source and further selectively provide a water spray directed radially outward from the housing. Flow control mechanisms associated with the tubing enable the user to select the desired spray pattern.

4 Claims, 2 Drawing Sheets

INFLATABLE WATER TOY

FIELD OF THE INVENTION

The present invention relates to a toy, and more particularly to a self-righting inflatable toy having means coupleable to a source of water for producing a water spray.

BACKGROUND OF THE INVENTION

It is appreciated that games, toys and devices intended for outdoor use which involve the use of water have been historically popular. Such items are typically coupleable to a source of water such as a garden hose and include means for producing a spray or stream which may be directed onto the bodies of the users. These items, in addition to their play or amusement value, carry the benefit of providing a means for children to cool off on hot summer days. This function is particularly attractive when convenient access cannot be had to a lake, pond, swimming pool or other body of water. Furthermore, young children may generally utilize these devices without the need for close parental supervision associated with the use of a swimming pool or the like.

The prior art contains a large number of water toys and games of the foregoing general description. Representative examples of this type of amusement device are disclosed in U.S. Pat. Nos. 4,235,378 ("Water Play Toy", issued to Melin et. al.); U.S. Pat. No. 5,462,284 ("Amusement Outdoor Water Display", issued to Felsenthal), and; 5,405,294 ("Participatory Water Play Apparatus", issued to Briggs). The Melin et. al. patent teaches a toy in the shape of an animal or cartoon character which is provided with a plurality of flexible tubes which exhibit a twisting or writhing action in response to the action and reaction forces created within the tubes by the flow of water therethrough. The Felsenthal patent teaches a tetherball-like game device including means for producing sprays emanating from the central tether pole, the sprays tending to impinge on the ball and thereby impart a randomized motion. Finally, the Briggs patent teaches a system of interconnected pipes, conduits, user-actuable valves and play elements arranged to define a three-dimensional "water park" structure.

One common characteristic of many water toys and games is their large size and rigid construction. As a general rule, large items provide more marketing appeal to children than do smaller items of a similar nature. However, because of their size, these items are relatively expensive to manufacture, package and ship. Moreover, their rigid construction may leave them susceptible to breakage when roughly handled, and may present safety concerns in cases where the toy or game is to be used by small children who may collide with or fall onto the rigid components of the toy or game.

Inflatable toys and games are also well known in the art. These items carry the advantage of being expandable to a large size when in use and collapsible into a compact volume for packaging or storage when deflated. Furthermore, inflatable toys are intrinsically rounded and possess soft, deformable surfaces when in the inflated condition, making them generally safe for use by small children.

To promote their active use by children, some inflatable devices are provided with ballasting to produce a self-righting action. When a self-righting inflatable device is pushed, kicked, bumped or otherwise struck by the user, it tilts in the general direction of the blow and then returns to the initial stable upright position. Representative variations on the self-righting inflatable concept are described in U.S. Pat. No. 4,268,030 ("Inflatable Action Toy", issued to Richards); U.S. Pat. No. 4,655,722 ("Water Spouting Inflatable Bop Bag", issued to Baron et. al.); U.S. Pat. No. 4,770,412 ("Free-Standing, Self-Righting Sculptured Punching Bags", issued to Wolfe), and; U.S. Pat. No. 4,787,875 ("Water Sprouting Inflatable Bop Bag", issued to Baron et. al.).

SUMMARY OF THE INVENTION

The present invention utilizes the advantageous aspects of the devices described in the foregoing section to create an inflatable water toy which will have great amusement and recreational value. The invention generally teaches an upstanding ballasted inflatable housing having a rounded base portion and an elongated shaft portion, means for producing water sprays emanating from the top and sides of the housing, and tubing means for delivering the water from a garden hose or other source of water to the spray means. In a typical commercial construction of the invention, the overall height of the device is between seven and ten feet, with the shaft portion comprising a substantial majority of the device's height. A diaphragm positioned within the housing divides the interior into a lower ballast compartment and an upper inflatable volume.

The water toy is provided with tubing means having a first end disengageably coupleable to a garden hose, and a second end connected to the spray head disposed at the upper end of the shaft. A portion of the tubing means intermediate the ends thereof is carried on the outer surface of the housing, the tubing means describing an ascending spiral path. In its preferred form, the tubing means comprises an extruded construction defining first and second channels, the channels being distinct and separate. The intermediate portion of the first channel is adapted with a plurality of spray-forming apertures for producing a water spray directed radially outward from the housing. The second channel, having unperforated walls, functions to supply water to the spray head which is adapted with vertically oriented spray orifices for producing a spray directed vertically upward from the shaft.

The tubing means is preferably provided with a system of valves operable by the user to selectively admit or obstruct flow to each of the channels, thereby selecting the radial spray, the vertical spray, or both.

It is submitted that the present invention achieves several significant objectives. First, an inflatable water toy is provided which may be manufactured and packaged inexpensively. Second, the toy's dramatic height, when inflated, will be very attractive to children, yet the toy may be collapsed compactly for packaging and storage. Third, the toy may be used safely by children, including very young children. Fourth, the toy may be used in connection with existing play equipment to create a water play area having substantial amusement value. Fifth, the toy is provided with means to adjust the spray pattern according to the user's desire. Finally, the toy's ballasting permits its active use by children. Other and further objectives achieved by the present invention will occur to those skilled in the art upon review of the detailed description of a preferred embodiment and the accompanying figures.

DETAILED DESCRIPTION OF THE INVENTION

Reference being made to the figures, it is seen that the water toy according to the preferred embodiment of the present invention generally comprises housing 2 defining interiorly thereto gas-inflatable chamber 4. The housing includes spheroidal base 6 surmounted by upstanding elongated shaft 8. The base is adapted to be supported on a generally flat surface such as a lawn, sidewalk or driveway. Alternatively, the housing may be floated in an upright position in a pool or other body of water. As will be discussed in more detail below, the housing is provided with ballasting material disposed in the bottommost regions thereof as to enable a self-righting action. It is noted that while the outer surface of the housing is depicted herein as generally plain and unadorned, the outer surface of the housing may carry printing or other decoration to enhance its appearance. In a typical commercial construction of the present invention, the housing is fabricated from a vinyl plastic, although any suitable flexible, resilient and gas-impermeable material or combination of materials may be substituted therefor.

Figure 2:
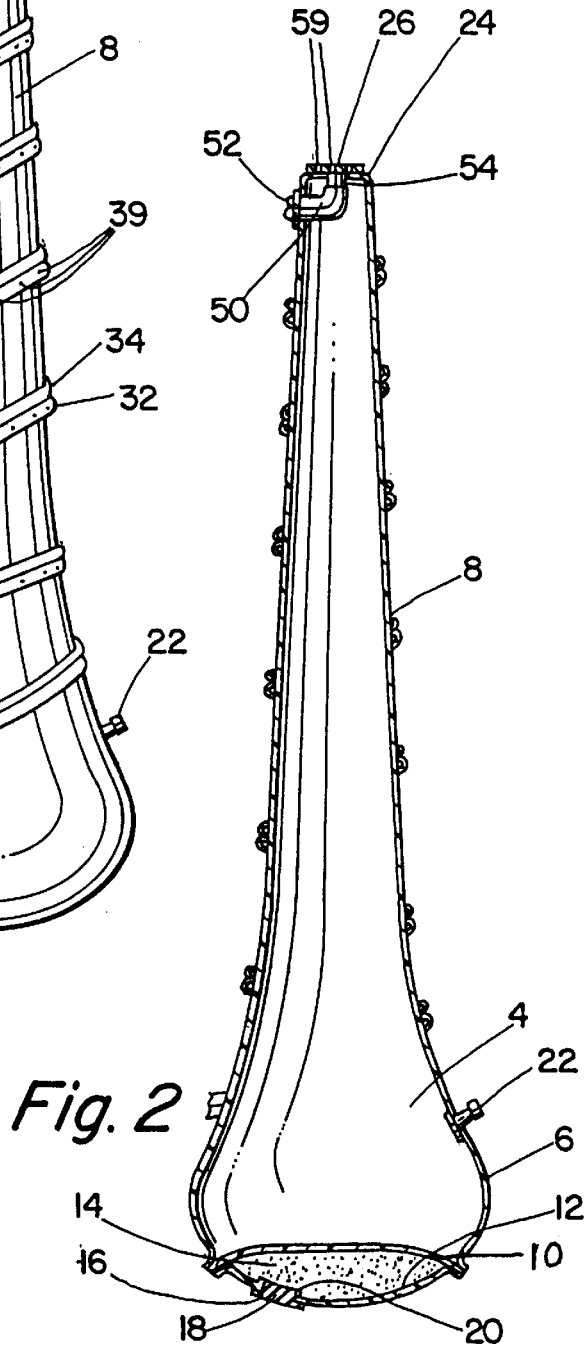
FIG. 2 is a longitudinal cross-sectional view of the water toy.

Referring now to FIG. 2, it is seen that diaphragm 10 divides the interior of the housing into a lower ballast chamber 12 and an upper inflatable compartment 4. The outer margins of the diaphragm may be fitted in sandwiched heat sealed engagement about the wall of the base (as depicted) or may alternatively be joined in gas tight fashion to the walls by an adhesive. It is noted that the bottom portion of base 6 may be fabricated from a reinforced material such as Neoprene® to prevent rupture or tearing thereof resulting from contact with an abrasive surface such as a paved driveway or sidewalk.

Ballasting material 14 contained within ballast compartment 12 enables the self-righting action of the toy by maintaining the device's center of gravity close to its bottom end. Thus, the device will be held in an upright position on a supporting surface and will return to the upright position when intentionally or accidently perturbed therefrom. Conventionally, self-righting inflatable devices have been sand-ballasted, with the sand being permanently sealed within the ballast compartment during manufacture of the device. However, the additional weight associated with the sand substantially increases shipping costs and necessitates the use of heavier packaging materials, which in turn drives up the retail cost of the device. Therefore, the present invention advantageously utilizes water as the ballasting material. Returning to FIG. 2, water port 16 disposed in the bottom portion of base 6 adjacent to ballast compartment 12 permits addition of water to the ballast compartment by the user. The water port includes stopper 18 which is normally engaged with seat 20 to prevent the outflow of water from the ballast compartment. The stopper may be disengaged from the seat to allow filling and draining of water to or from the ballast compartment. It is seen that the outer face of the stopper is substantially planar and positioned to be flush with the surrounding portion of the base so as to minimize its interference with the rolling or rocking motion of the device.

Housing 2 is provided with standard air valve 22 positioned adjacent to inflatable chamber 4 to enable inflation and deflation of the housing. The air valve includes a hinged stopper which when engaged prevents air from escaping from the inflatable chamber.

Figure 4:
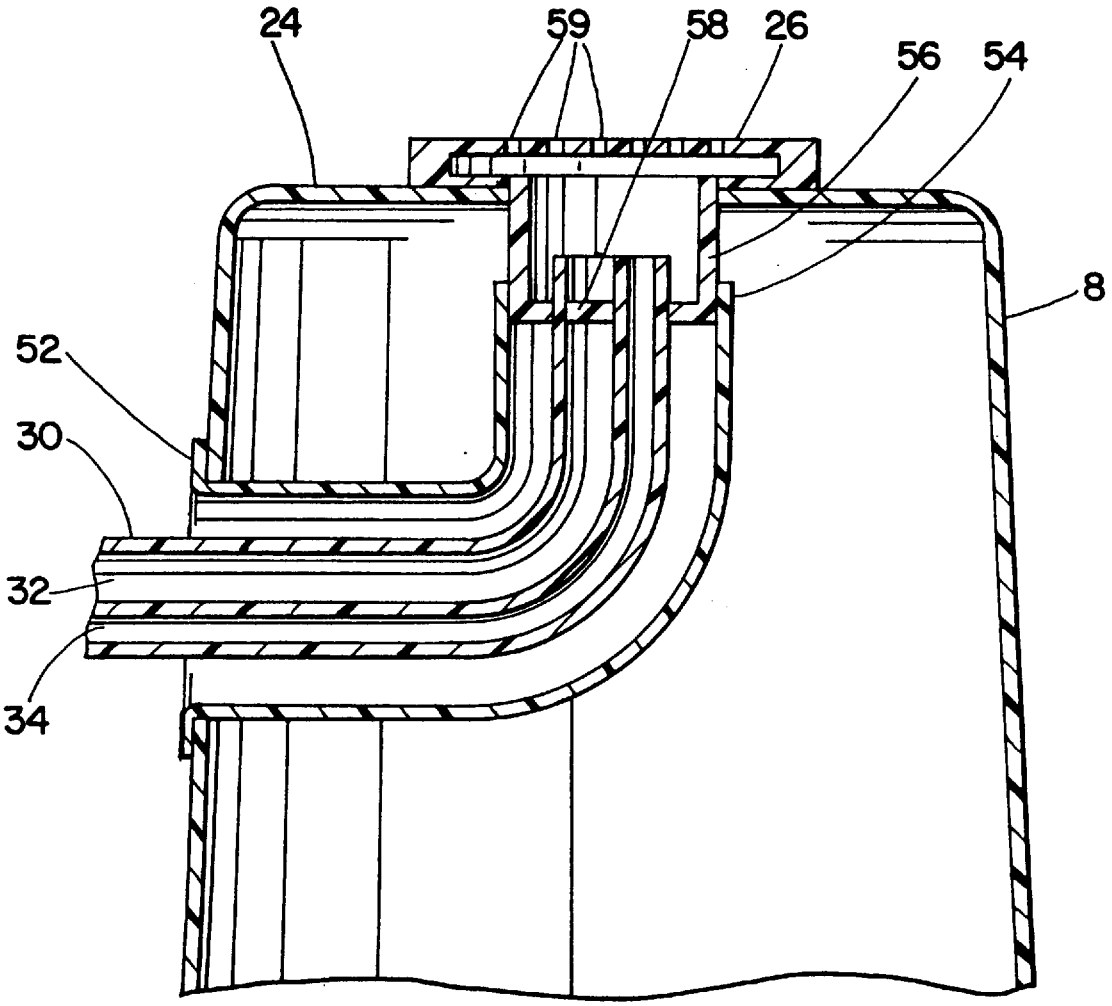
FIG. 4 is a fragmentary longitudinal cross-sectional view of the water toy, showing in particular the connection of the tubing means to the spray head at the upper end of the shaft.

Shaft portion 8 of housing 2 is constructed in an elongated generally cylindrical shape. The proximal end of the shaft is contiguous with the upper margins of base 6. The shaft terminates at its distal end in roof 24 to which is sealedly mounted spray head 26. Reference being made to FIG. 4, the spray head is adapted with orifices 39 through which water is directed to form a spray oriented generally vertically upward from the shaft roof.

It has been noted that a shaft formed in a generally cylindrical shape may tend to buckle and flop over when extended beyond a certain length. An alternative embodiment of the water toy remedies this deficiency by providing a shaft having co-extensive inner and outer walls defining therebetween an annular inflatable chamber. The central volume of the shaft interior to the inner wall is open to the atmosphere.

Reference being made again to FIGS. 1 and 2, tubing means 30 are provided having a first end disengageably coupleable to garden hose 41 and a second end connected to the inlet of spray head 26. A portion of the tubing means intermediate the ends thereof is carried on the outer surface of housing 2 describing an ascending spiral path thereon. The tubing means are preferably secured to the housing outer surface by grommets 42. As may be discerned by reference to FIG. 3, the grommets comprise flat base 44 affixed by adhesive, heat sealing or equivalent means to the housing outer surface and outstanding transverse flap 46 adapted with cutout 48 conforming closely to tubing means 30. The flap frictionally engages the adjacent portion of the tubing means preventing slippage thereof relative to the grommet.

Figure 1:
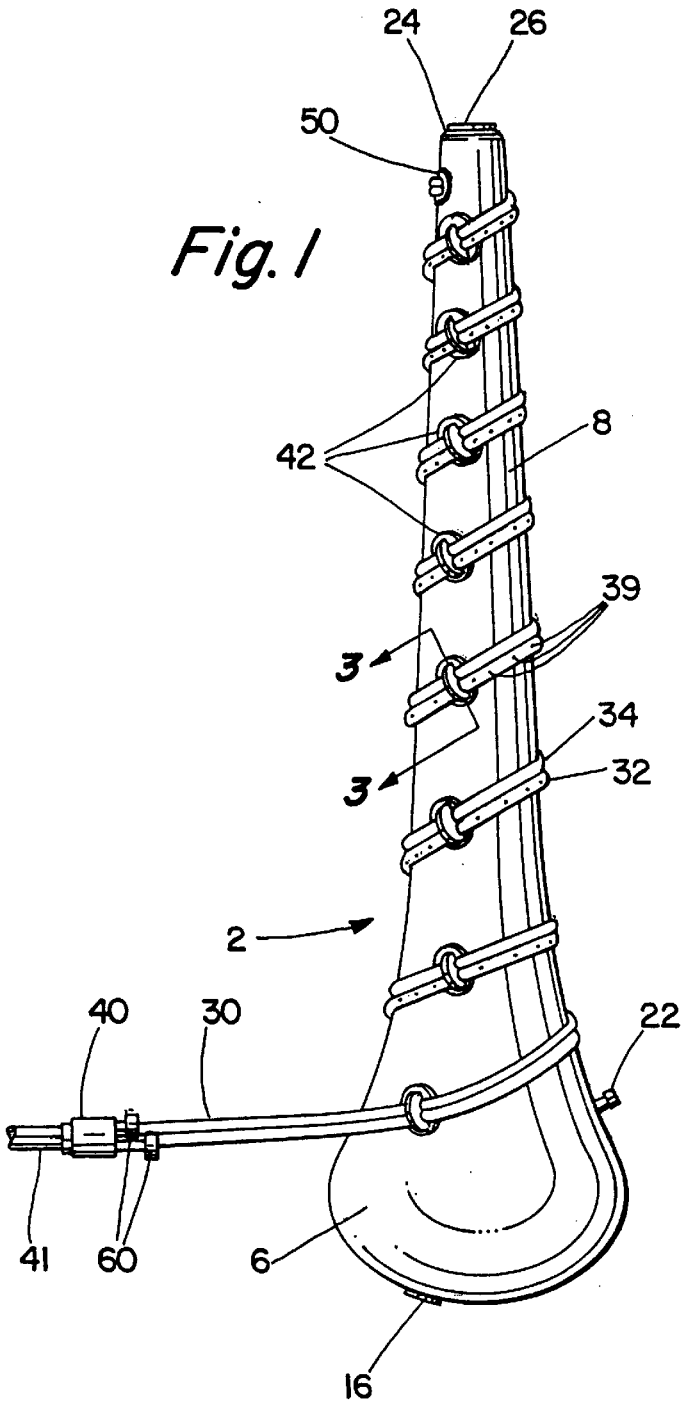
FIG. 1 is a front elevational view of a water toy according to the present invention.
Figure 3:
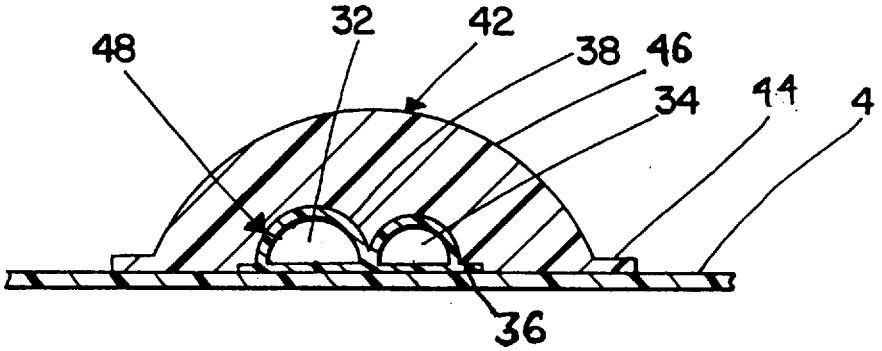
FIG. 3 is a fragmentary cross-sectional view of the water toy taken along line 3—3 of FIG. 1, showing in particular the arrangement of grommet and tubing means.

The preferred construction of tubing means 30 is best appreciated by reference to FIG. 3. The tubing means comprises a flat or base portion 36 and double arched portion 38 defining interiorly thereto separate and distinct first channel 32 and second channel 34. The tubing means are preferably integrally fabricated by an extrusion technique from a flexible polymeric material such as polyethylene. First channel 32 and second channel 34 have different functions. Referring to FIG. 1, tubing means 30 is adapted along its intermediate portion with a plurality of spray orifices 39 formed adjacent to first channel 32 and oriented outwardly from the housing. Water entering the first channel is directed through the spray orifices to produce a water spray oriented radially outward from the housing. The size and spacing of spray orifices 39 may be adjusted for a particular application to provide a desired spray geometry. As is discussed in more detail hereinbelow, flow control means are preferably provided to selectively shut off or permit flow to the first channel thereby turning the radial spray on and off.

Second channel 34 functions to convey water from garden hose 41 to spray cap 26. The tubing means adjacent the second channel are unperforated. Reference being made to FIG. 4, it is seen that the tubing means penetrate shaft 8 proximal to the upper end thereof. In order to allow the tubing means to penetrate the shaft wall without allowing leakage of air from interior chamber 4, L-shaped pass-through 50 is provided having a hollow interior with a generally circular cross section through which the terminal portion of the tubing meas is threaded. The pass-through includes lower end 52 sealed to the shaft wall and upper end 54 sealed to the depending portion of spray head 26. The second end of the tubing means is connected to the inlet of the spray head. It is noted that plug 58 is provided to block the end of first channel 32 thereby forcing all of the water entering the first channel to be directed through spray orifices 39 thereby producing the radially oriented spray. Water entering the spray head from the second channel is thereafter directed through vertically oriented spray orifices 59 to form a water spray directed vertically upward therefrom.

The first end of the tubing means terminates in hose coupling 40 having an internally threaded sleeve for engagement with the externally threaded terminal fitting of garden hose 41. Proximal to the hose coupling are provided flow control means 60 comprising valves operable by the user to selectively admit or obstruct the flow of water to the first and second channels. It is known in the art to provide ball valves or gate valves for this purpose, although any suitable configuration of valves may be employed. The position of the valves determines the spray pattern produced. With both valves in the closed position, no spray is produced. When the valve associated with the first channel is opened while the valve associated with the second channel is closed, only a side or radial spray emanating from orifices 39 is achieved. When the valve associated with the first channel is closed while the valve associated with the second channel is opened, only the spray directed vertically upward from orifices 59 of spray head 26 is achieved. Finally, when both valves are opened, the radially and vertically oriented sprays are achieved simultaneously. The inclusion of the flow control means significantly enhances the amusement value of the toy by permitting the user to actively control the spray pattern produced therefrom.

It is contemplated that multiple water toys of the foregoing description may be coupled to a single garden hose by use of a commercially available Y- or multiple-outlet hose connector. It is further contemplated that one or more toys may be set up in the vicinity of outdoor activity sets such as a swing set or slide to create a "water play area" having great amusement value.

While specific embodiments of the invention have been shown and described, it will be apparent to those skilled in the art that various modifications may be made without departing from the spirit of the present invention. For that reason, the scope of the invention is set forth in the following claims.

What is claimed is:

1. A water toy comprising:

a closed housing comprising a rounded base and an elongated shaft, said housing being fabricated from a flexible and substantially gas-impervious material and defining interiorly thereto a hollow chamber;

a diaphragm disposed within said chamber, the peripheral edges of said diaphragm being in sealed engagement with said housing thereby defining a lower ballast compartment and an upper inflatable chamber;

an air valve disposed in said housing adjacent said upper inflatable chamber, said air valve enabling the addition of air to said inflatable chamber, said air valve including closure means preventing the egress of air from said inflatable chamber when engaged;

ballasting material held within said ballast compartment thereby producing a self-righting action wherein said housing will tend to return to a normal upright position when displaced therefrom;

spray head means positioned at the upper end of said shaft, said spray head means causing a spray of water to be directed substantially vertically upward from said shaft, and;

tubing means having a first end disengageably coupleable to a garden hose and a second end connected to and communicating with said spray head means, a portion of said tubing means intermediate the first and second ends thereof being carried on the outer surface of said housing and describing an ascending spiral path thereon, said tubing means being adapted with a plurality of orifices for forming a water spray directed radially outward from said housing.

2. A water toy according to claim 1 wherein said tubing means comprises first and second coextensive channels in side-by-side relationship, said first and second channels being distinct and separate, each channel having a first and a second end, said first ends of said channels communicating with a source of water at elevated pressure, said first channel being adapted with a plurality of orifices for forming a spray directed radially outward from said housing, said second channel having continuous and unperforated walls and having a second end connected to said spray head means for supplying a flow of water thereto, said tubing means further comprising flow control means positioned proximate to said first end of said tubing means, said flow control means being operable by the user to independently admit or obstruct the flow of water to each channel and thereby select the spray pattern produced.

3. A water toy according to claim 2, further comprising at least one grommet for securing said tubing means to said housing.

4. A water toy comprising an upstanding ballasted inflatable housing having a rounded lower base portion and an upper shaft portion, spray producing means positioned at the top of said housing and tubing means connecting said spray producing means to a source of pressurized water, said tubing means being carried on the outer surface of said housing and being adapted with a plurality of orifices for producing a spray directed radially outward from the housing, whereby a self-righting inflatable water toy is provided having water sprays directed from the top and sides of said housing.

* * * * *